US010767552B2

(12) United States Patent
Mikawa

(10) Patent No.: US 10,767,552 B2
(45) Date of Patent: Sep. 8, 2020

(54) CONTROL APPARATUS AND CONTROL METHOD FOR VARIABLE VALVE TIMING MECHANISM

(71) Applicant: HITACHI AUTOMOTIVE SYSTEMS, LTD., Hitachinaka-shi, Ibaraki (JP)

(72) Inventor: Kentaro Mikawa, Isesaki (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 117 days.

(21) Appl. No.: 15/580,828

(22) PCT Filed: Jun. 16, 2016

(86) PCT No.: PCT/JP2016/067958
§ 371 (c)(1),
(2) Date: Dec. 8, 2017

(87) PCT Pub. No.: WO2016/204236
PCT Pub. Date: Dec. 22, 2016

(65) Prior Publication Data

US 2018/0340465 A1 Nov. 29, 2018

(30) Foreign Application Priority Data

Jun. 16, 2015 (JP) ..... 2015-121346

(51) Int. Cl.
*F02B 33/18* (2006.01)
*F02D 13/02* (2006.01)
(Continued)

(52) U.S. Cl.
CPC ..... *F02B 33/18* (2013.01); *F01L 1/344* (2013.01); *F02D 13/02* (2013.01); *F02D 41/009* (2013.01);
(Continued)

(58) Field of Classification Search
CPC ..... F02B 33/18; F02D 41/062; F02D 41/009; F02D 13/02; F02D 2041/0092;
(Continued)

(56) References Cited

U.S. PATENT DOCUMENTS 4,873,958 A * 10/1989 Abe ..... F02P 5/1553 123/406.54
2005/0211207 A1 9/2005 Urushihata et al.
(Continued)

FOREIGN PATENT DOCUMENTS

JP 2008-510092 A 4/2008
JP 4123127 B2 7/2008
(Continued)

*Primary Examiner* — Jacob M Amick
*Assistant Examiner* — Charles Brauch
(74) *Attorney, Agent, or Firm* — Foley & Lardner LLP

(57) ABSTRACT

The present invention has: a crank angle sensor 4 that outputs a crank angle signal in response to rotation of a crankshaft 2, the crank angle signal being preset to indicate reference positions; a cam sensor 5 that outputs cam signal pulses in response to rotation of an intake camshaft 3 for opening and closing an engine valve; an electric motor 6 that relatively rotates intake camshaft 3 with respect to crankshaft 2, so that electric motor 6 can change a rotational phase angle of intake camshaft 3 with respect to crankshaft 2; and an electronic control unit 7 that computes an actual rotational phase angle of intake camshaft 3 based on a first cam signal pulse detected after start of cranking and a first reference position of the crank signal detected thereafter, to calculate an absolute position of a variable valve timing mechanism 14.

6 Claims, 9 Drawing Sheets

(51) Int. Cl.

| | |
|---|---|
| ***F01L 1/344*** | (2006.01) |
| ***F02D 41/00*** | (2006.01) |
| ***F02D 41/06*** | (2006.01) |
| ***F01L 1/053*** | (2006.01) |

(52) U.S. Cl.
CPC .... *F02D 41/062* (2013.01); *F01L 2001/0537* (2013.01); *F01L 2250/02* (2013.01); *F01L 2800/01* (2013.01); *F01L 2820/032* (2013.01); *F02D 2041/001* (2013.01); *F02D 2041/0092* (2013.01)

(58) Field of Classification Search
CPC ..... F02D 2041/001; F01L 1/344; F01L 2820/032; F01L 2800/01; F01L 2001/0537; F01L 2250/02
See application file for complete search history.

(56) References Cited

U.S. PATENT DOCUMENTS

| | | | | |
|---|---|---|---|---|
| 2005/0268871 | A1* | 12/2005 | Hirowatari ..... | F02D 41/0002 123/90.15 |
| 2006/0260573 | A1 | 11/2006 | Urushihata et al. | |
| 2008/0210021 | A1 | 9/2008 | Steinruecken et al. | |
| 2009/0265077 | A1 | 10/2009 | Urushihata et al. | |

FOREIGN PATENT DOCUMENTS

| | | | |
|---|---|---|---|
| JP | 2009-257186 | A | 11/2009 |
| JP | 2015-001167 | A | 1/2015 |

* cited by examiner

CONTROL APPARATUS AND CONTROL METHOD FOR VARIABLE VALVE TIMING MECHANISM

TECHNICAL FIELD

The present invention relates to a control apparatus for a variable valve timing mechanism, and more specifically, relates to a control apparatus and a control method for a variable valve timing mechanism, capable of achieving a quick calculation of an absolute position of the variable valve timing mechanism at startup.

BACKGROUND ART

A conventional control apparatus for a variable valve timing mechanism has been configured to calculate an actual valve timing at the time of outputting a cam signal based on a crank angle signal output from a crank angle sensor and the cam signal output from a cam sensor, and to calculate a varied amount of a valve timing with respect to the actual valve timing at the time of outputting the cam signal based on a difference in rotational speed between a motor and an intake camshaft, so as to calculate a final actual valve timing by using the actual valve timing at the time of outputting the cam signal and the valve timing varied amount (see, for example, Patent Document 1).

REFERENCE DOCUMENT LIST

Patent Document

Patent Document 1: JP 4123127 B2

SUMMARY OF THE INVENTION

Problems to be Solved by the Invention

However, regarding such a conventional control apparatus of a variable valve timing mechanism, the Patent Document 1 does not disclose a technique for achieving a quick calculation of a true rotational phase angle of the intake camshaft, that is, an absolute position of the variable valve timing mechanism, at startup. Therefore, it might be difficult to achieve improved startup performance of a vehicle.

Thus, in view of the problem, an object of the present invention is to provide a control apparatus and a control method for a variable valve timing mechanism, capable of achieving quick calculation of an absolute position of the variable valve timing mechanism at startup.

Means for Solving the Problems

To achieve the object, a control apparatus for a variable valve timing mechanism according to the present invention, comprises:

a crank angle sensor that outputs a crank angle signal in response to rotation of a crankshaft, the crank angle signal being set in advance to indicate at least two reference positions;

a cam sensor that outputs at least two cam signal pulses in response to rotation of an intake camshaft for opening and closing an engine valve;

an actuator that relatively rotates the intake camshaft with respect to the crankshaft, so that the actuator is able to change a rotational phase angle of the intake camshaft with respect to the crankshaft; and a control unit that computes an actual rotational phase angle of the intake camshaft based on a first cam signal pulse detected after start of cranking and a first reference position of the crank signal detected thereafter, to calculate an absolute position of the variable valve timing mechanism.

Furthermore, a control method of a variable valve timing mechanism according to the present invention, comprises:

a first step of starting cranking;

a second step of starting to receive a crank angle signal output from a crank angle sensor in response to rotation of a crankshaft, the crank angle signal being set in advance to indicate at least two reference positions, and starting to receive at least two cam signal pulses output from a cam sensor in response to rotation of an intake camshaft for opening and closing an engine valve;

a third step of obtaining a first cam signal pulse after the start of cranking;

a fourth step of obtaining a first reference position of the crank angle signal after the third step; and a fifth step of computing an actual rotational phase angle of the intake camshaft with respect to the crankshaft based on the cam signal pulse obtained in the third step and the reference position obtained in the fourth step, to calculate an absolute position of the variable valve timing mechanism.

Effects of the Invention

According to the present invention, a quick calculation of the absolute position of the variable valve timing mechanism at startup can be achieved. Thus, startup performance of a vehicle can be improved.

MODE FOR CARRYING OUT THE INVENTION

Figure 1:
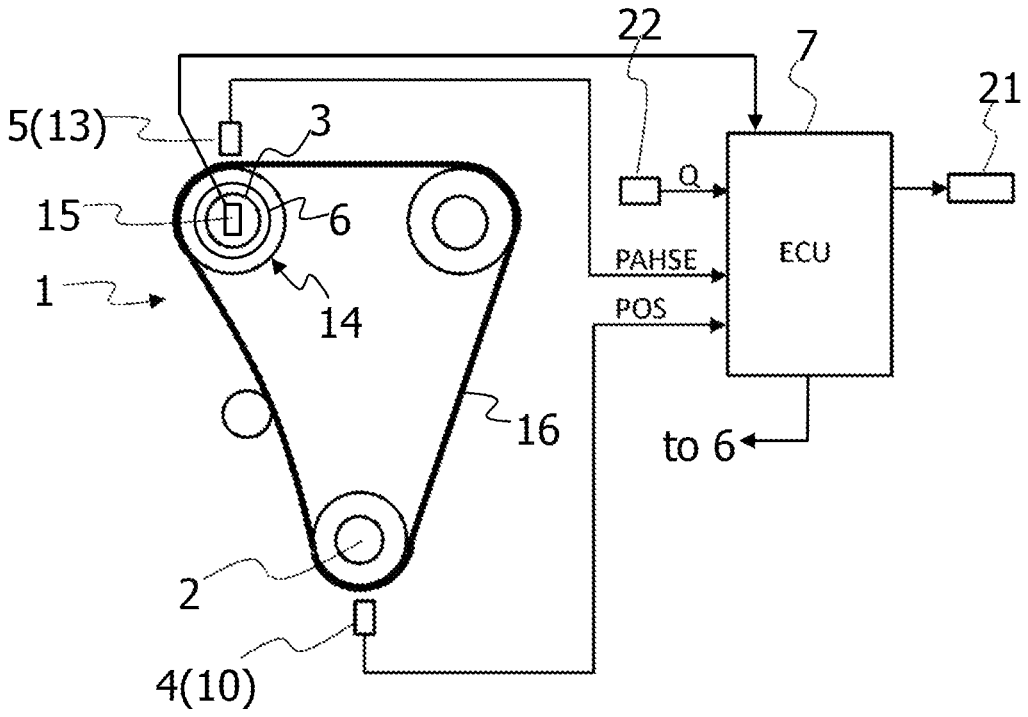
FIG. 1 is a schematic view illustrating a control apparatus for a variable valve timing mechanism according to an embodiment of the present invention.

Hereinbelow, embodiments of the present invention will be described with reference to the accompanying drawings. FIG. 1 is a schematic view illustrating a control apparatus for a variable valve timing mechanism according to an embodiment of the present invention. The control apparatus for the variable valve timing mechanism controls a relative rotational phase angle between a crankshaft 2 and an intake camshaft 3 of an internal combustion engine 1, and includes a crank angle sensor 4, a cam sensor 5, an electric motor 6, and an electronic control unit 7.

Figure 2:
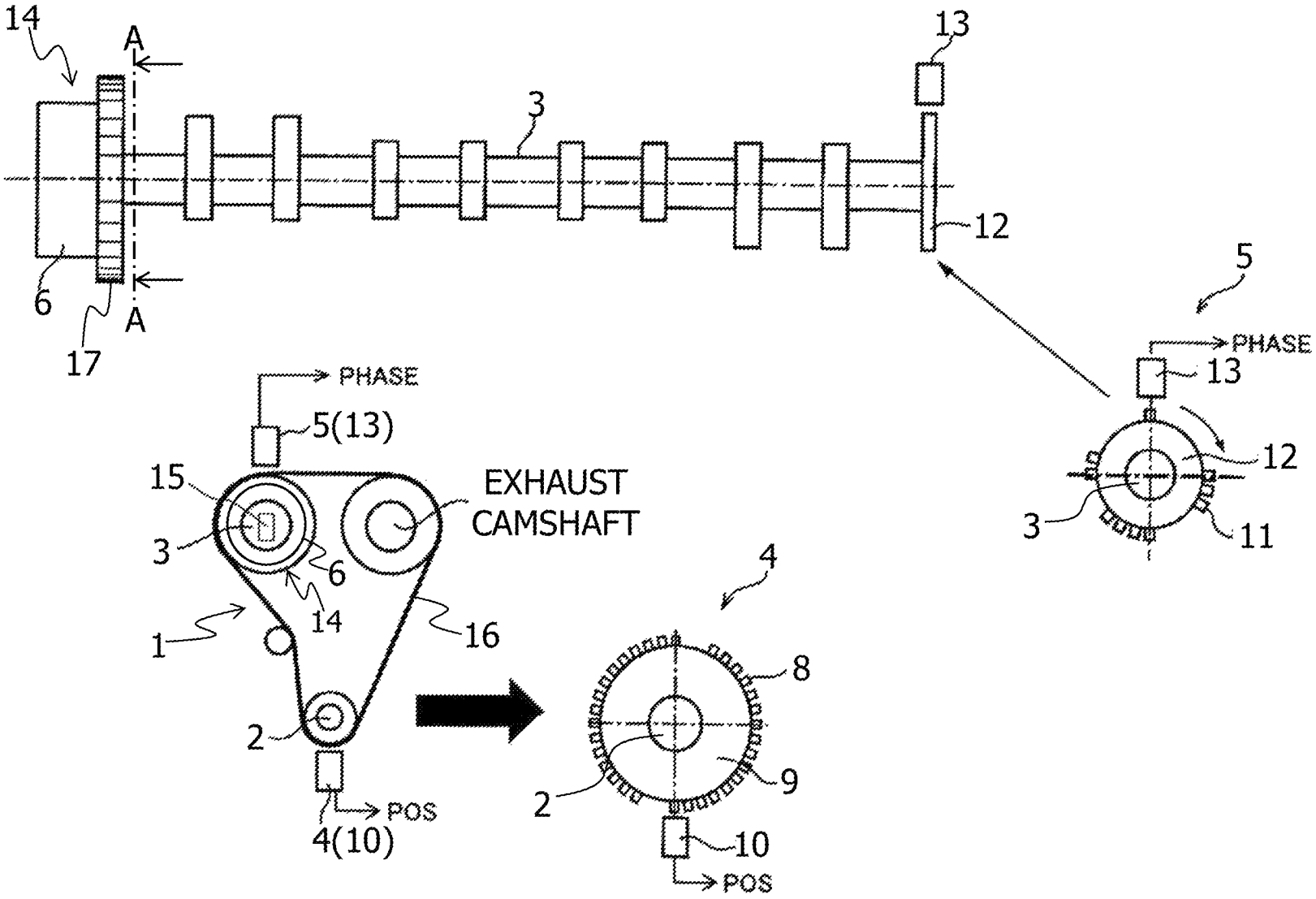
FIG. 2 is an explanatory view illustrating the structure of a crank angle sensor and the structure of a cam sensor in the control apparatus.

Crank angle sensor 4 outputs a pulsed rotation signal in response to the rotation of crankshaft 2, which is an output shaft of internal combustion engine 1, and specifically, as illustrated in FIG. 2, crank angle sensor 4 includes: a signal plate 9 axially supported by crankshaft 2 and having projections 8 formed therearound, serving as detected portions; and a rotation detecting device 10, which is secured to internal combustion engine 1, and that detects projections 8 and thereby outputs a crank angle signal POS.

Rotation detecting device 10 includes various processing circuits such as a wave form generating circuit and a selection circuit, together with a pickup for detecting projections 8. Crank angle signal POS output from rotation detecting device 10 is a pulse signal that forms a pulse train and that normally has low level and changes to be high level for a predetermined duration when projection 8 is detected.

Projections 8 of signal plate 9 are formed at even intervals with a 10-degree pitch in the crank angle. There are two absent portions of projections 8. In each of the absent portions, two projections 8 are consecutively absent. The two absent portions are located at opposite sides of the rotation center of crankshaft 2. However, the number of absent projections 8 may be one, or three or more projections 8 may be consecutively absent. In the following, a case in which the number of absent projections 8 is two will be described.

Figure 3:
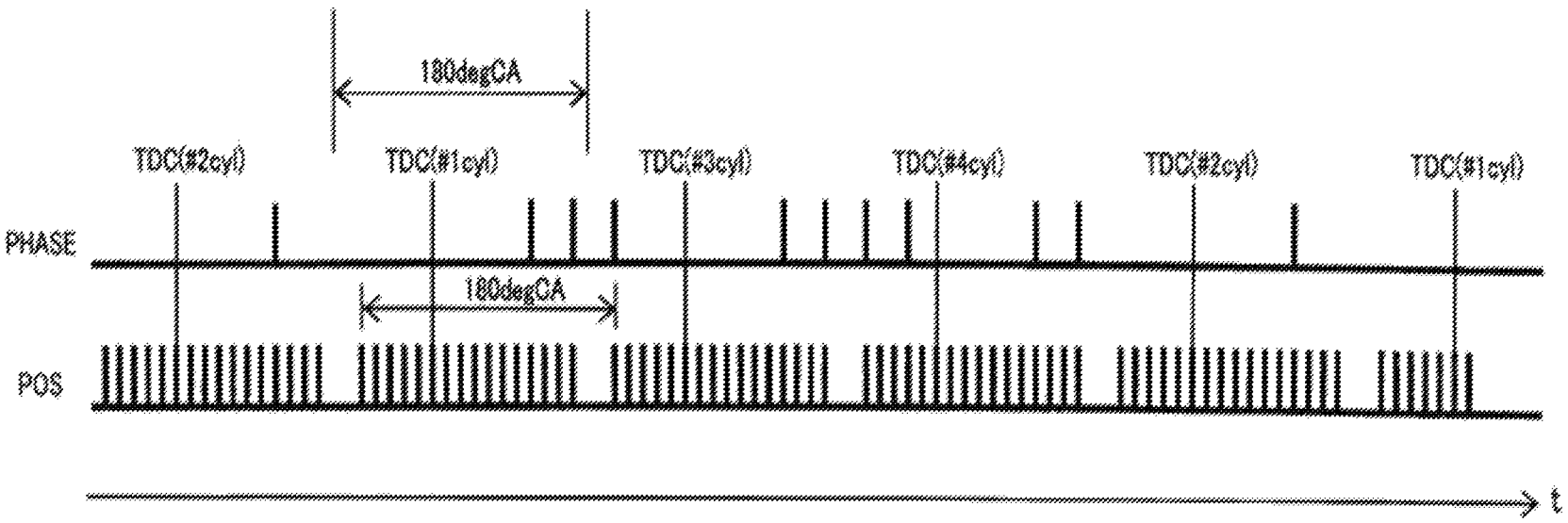
FIG. 3 is a timing chart illustrating the output characteristics of the crank angle sensor and the cam sensor.

By this structure, as illustrated in FIG. 3, crank angle signal POS output from crank angle sensor 4 (rotation detecting device 10) changes to be high level 16 times consecutively every 10 degrees in the crank angle (unit crank angle), followed by remaining at the low level for 30 degrees, and thereafter, crank angle signal POS again changes to be high level 16 times consecutively.

Thus, a first crank angle signal output after the low-level period of 30 degrees in the crank angle (which is an absent projection region, or an absent portion, hereinafter, referred to as a "reference position") will be output at an interval of 180 degrees in the crank angle. This 180-degree crank angle corresponds to a stroke phase difference between cylinders in a four-cylinder engine, in other words, corresponds to an ignition interval.

Cam sensor 5 is configured to make a rotational angle of intake camshaft 3 for opening and closing an internal combustion engine valve detectable, and specifically, as illustrated in FIG. 2, cam sensor 5 includes: a signal plate 12 axially supported by one end of intake camshaft 3 and having projections 11 formed therearound, serving as detected portions; and a rotation detecting device 13, which is secured to internal combustion engine 1, and that detects projections 11 and thereby outputs a cam signal PHASE.

Rotation detecting device 13 includes various processing circuits such as a waveform generating circuit, together with a pickup for detecting projections 11.

One, three, four and two projections 11 of signal plate 12 are located at four positions per 90-degree cam angle. A pitch of projections 11 is set to 30 degrees in the crank angle (15 degrees in the cam angle) at a portion in which at least two projections 11 are formed consecutively.

Cam signal PHASE output from cam sensor 5 (rotation detecting device 13) is a pulse signal that forms a pulse train and that normally has low level and changes to be high level for a predetermined duration when projection 11 is detected, the pulse signal changing to be high level once alone, three times consecutively, four times consecutively, and twice consecutively for every 90 degrees in the cam angle or 180 degrees in the crank angle.

Furthermore, the cam signal output alone and the first signal of at least two cam signals output consecutively (hereinafter, referred to as "cam signal pulses") are configured to be output at a period of 180 degrees in the crank angle.

On the other end of intake camshaft 3, electric motor 6 (actuator) is provided as illustrated in FIG. 2. Electric motor 6 constitutes a part of a variable valve timing mechanism (hereinafter, referred to as an "electric VTC") 14 that changes the rotational phase of intake camshaft 3 with respect to crankshaft 2, thereby changing a valve timing of an intake valve that opens and closes an opening of an intake port, through which intake air is introduced into a combustion chamber of each cylinder of internal combustion engine 1. Furthermore, electric motor 6 is provided with a motor rotation sensor (actuator sensor) 15, having a high detection frequency, capable of obtaining a motor shaft rotational angle (manipulated amount) of electric motor 6 including the rotation direction thereof at any timing.

Electric VTC 14 is integrated with a timing sprocket 17, around which a timing chain 16 for transmitting the rotational driving force of crankshaft 2 is wrapped, and electric VTC 14 is configured to have intake camshaft 3 relatively rotate with respect to timing sprocket 17 by electric motor 6, which includes a built-in reduction gear unit, to thereby advance or retard the valve timing. Electric VTC 14 is not limited to be provided for the intake valve, and it may be provided for at least one of the intake valve and an exhaust valve.

Figure 4:
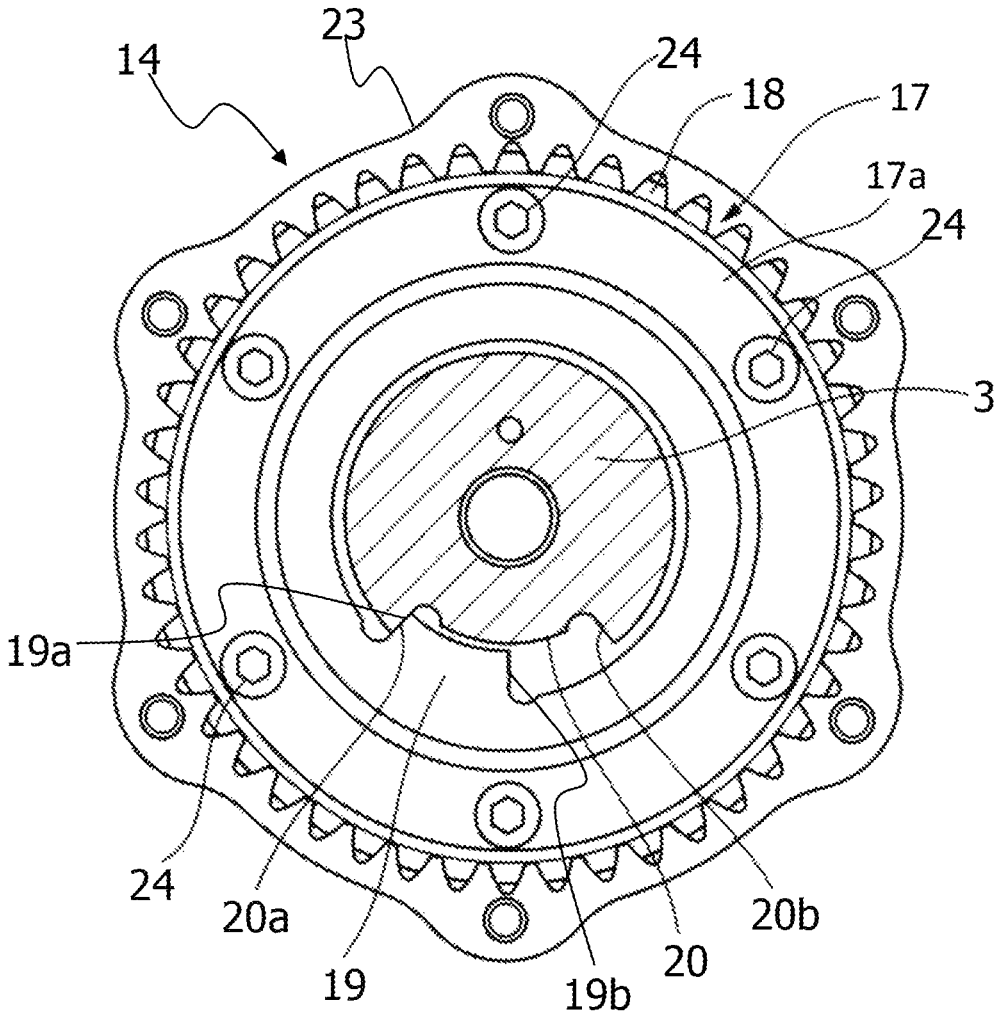
FIG. 4 is a cross-sectional view taken along with a line A-A of FIG. 2.

Specifically, as illustrated in FIG. 4, which is the cross-sectional view taken along line A-A of FIG. 2, electric VTC 14 includes: an annular sprocket main body 17*a* having a stepped inner peripheral surface; and a gear 18, which is integrally provided on the outer periphery of sprocket main body 17*a*, gear 18 receiving a rotational force transmitted from crankshaft 2 via timing chain 16 wrapped therearound. Furthermore, timing sprocket 17 is rotatably supported on intake camshaft 3 by a ball bearing, not illustrated, interposed between an annular groove formed on the inner periphery of sprocket main body 17*a* and the outer periphery of a thick flange, not illustrated, integrally provided on the front end portion of intake camshaft 3.

Furthermore, as illustrated in FIG. 4, a portion of the inner peripheral surface of sprocket main body 17*a* is formed to have a stopper convex portion 19, serving as an arc-shaped engaging portion, having a predetermined length along the circumferential direction.

Furthermore, as illustrated in FIG. 4, the flange of intake camshaft 3 is formed to have a stopper concave groove 20, serving as a locking portion, which accepts stopper convex portion 19 of sprocket main body 17*a* and is formed along the circumferential direction. Stopper concave groove 20 is formed in an arc shape having a predetermined length along the circumferential direction. Both edges 19*a*, 19*b* of stopper convex portion 19, which circularly move within the range of the predetermined length, come in contact with opposite edges 20*a*, 20*b*, respectively, in the circumferential direction, to define relative rotational positions on the maximum advance angle side and the maximum retard angle side of intake camshaft 3 with respect to timing sprocket 17.

Electronic control unit (control unit) 7 is provided such that it is electrically connected to crank angle sensor 4, cam sensor 5, electric motor 6 and motor rotation sensor 15.

Electronic control unit 7 computes an actual rotational phase angle (hereinafter, referred to as the "actual rotational phase angle") of intake camshaft 3 based on a first cam signal pulse detected after start of cranking and a crank reference position, which is a first reference position of the crank angle signal, detected thereafter, to calculate an absolute position of electric VTC 14 (the actual rotational phase angle of electric VTC 14 with respect to crankshaft 2). Electronic control unit 7 includes a microcomputer, performs the computing process according to a program pre-stored in a storage unit, and outputs an operation signal for controlling drive of a fuel injection device 21 or electric motor 6.

The actual rotational phase angle of intake camshaft 3 corresponds to the absolute position of electric VTC 14. Thus, when the actual rotational phase angle of intake camshaft 3 is computed, the absolute position of electric VTC 14 can be calculated.

Specifically, electronic control unit 7 switches a drive mode of electric motor 6 from an OFF-drive to a drive with a feedback control, or from a drive with a feedforward control to the drive with the feedback control, at the time when the absolute position of electric VTC 14 is calculated, and electronic control unit 7 controls drive of electric motor 6 so that the absolute position of electric VTC 14 approaches a target position.

More specifically, when electric motor 6 is manipulated in a time period from the detection of the first cam signal pulse after the start of cranking until the detection of the crank reference position of the crank angle signal, electronic control unit 7 corrects the absolute position of the electric VTC 14 based on the motor shaft rotational angle (manipulated amount) received from motor rotation sensor 15.

Alternatively, when electric motor 6 is manipulated with a feedforward control after the start of cranking, electronic control unit 7 may obtain the motor shaft rotational angle (manipulated amount) of electric motor 6 by motor rotation sensor 15, to correct the absolute position of electric VTC 14 based on, among the obtained motor shaft rotational angles (manipulated amounts), a motor shaft rotational angle (manipulated amount) from the detection of the first cam signal pulse after the start of cranking until the detection of the crank reference position of the crank angle signal.

Preferably, when the absolute position of electric VTC 14 is other than an initial position (default position) of when internal combustion engine 1 is in a stop state, electronic control unit 7 may control drive of electric motor 6 so that the manipulated amount of electric motor 6 after the drive starts is reduced for a predetermined period of time.

Electronic control unit 7 may be configured to control the drive of electric VTC 14, and to perform intercommunication with an additional electronic control unit 7 for controlling fuel injection device 21, an igniter, and the like, of internal combustion engine 1. Furthermore, in FIG. 1, a reference number 22 is assigned to an airflow sensor for obtaining an intake air amount Q of internal combustion engine 1. Furthermore, in FIG. 4, a reference number 23 is assigned to a large-diameter annular plate for supporting a phase changing mechanism, not illustrated, which changes a relative rotational phase between timing sprocket 17 and intake camshaft 3, and a reference number 24 is assigned to a bolt for securing timing sprocket 17 to large-diameter annular plate 23.

Next, the operation of electric VTC 14 having the configuration described in the foregoing will be described.

In general, when internal combustion engine 1 stops, electric VTC 14 moves back to a predetermined default position (initial position) set in advance, and then stops. However, there may be a case in which electric VTC 14 has been displaced due to an external force in a previous stop state of internal combustion engine 1, and the position of electric VTC 14 deviates from the default position at startup. In such a case, a wrong absolute position of electric VTC 14 might be obtained. Thus, electric motor 6 might be driven to a target position based on a wrong feedback manipulated amount obtained based on the wrong position of electric VTC 14, and thus, there may be risks of colliding of stopper convex portion 19, illustrated in FIG. 4, with opposite edge 20*a* or 20*b* of stopper concave groove 20 of intake camshaft 3, resulting in damage, or risks of engaging and locking occurring in the cam mechanism for driving electric VTC 14.

According to the present invention, the control unit of electric VTC 14 is configured to start drive of electric motor 6 of electric VTC 14 after determining an absolute position θ1 of electric VTC 14 at startup.

Figure 5:
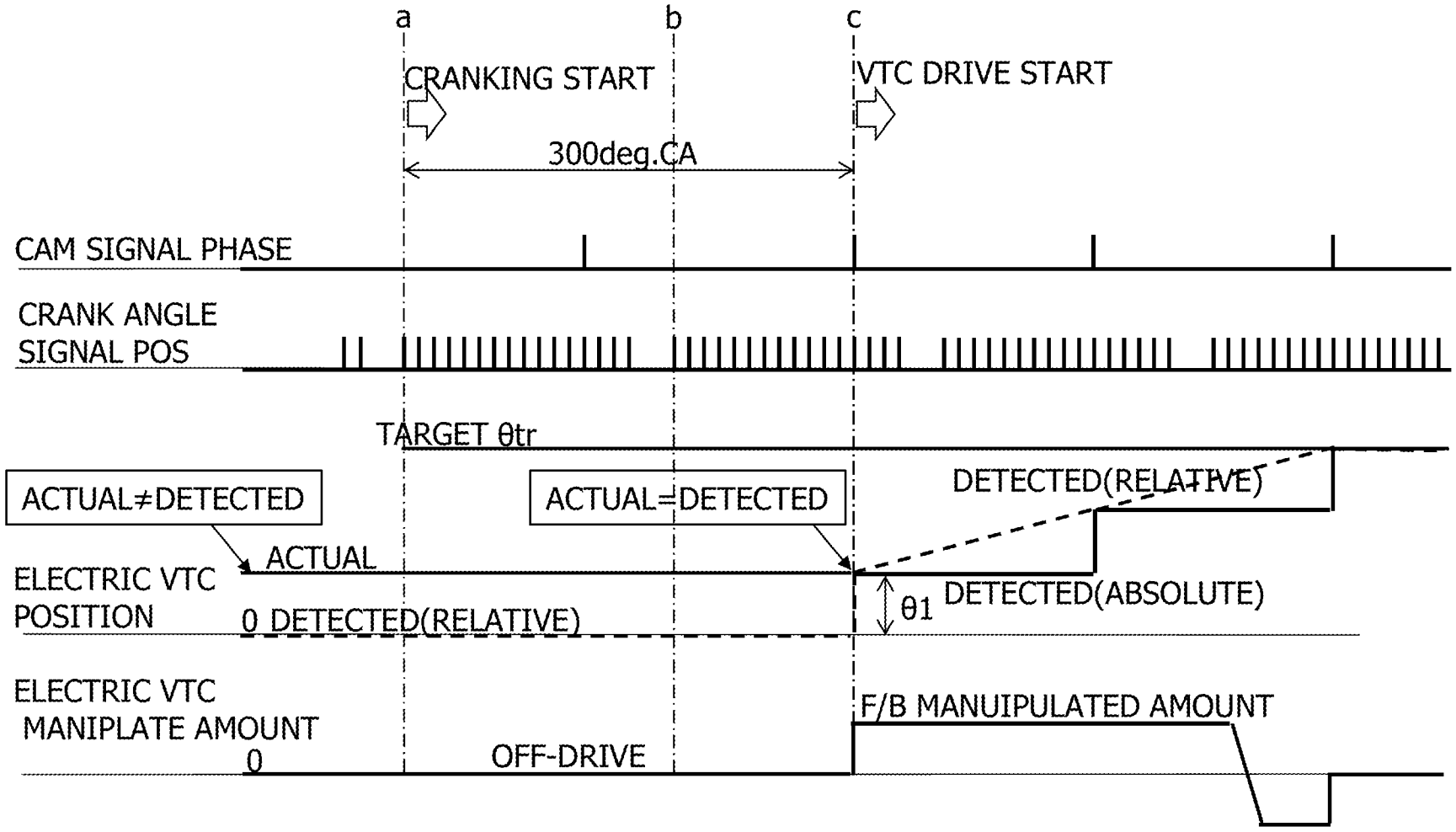
FIG. 5 is a timing chart for describing an example of a calculation method for obtaining an absolute position of the variable valve timing mechanism at startup.

An example of a method of determining the actual rotational phase angle of intake camshaft 3 with respect to crankshaft 2 at startup may include a method indicated in FIG. 5. That is, after start of cranking (time point a of FIG. 5), the first reference position of crank angle signal POS from crank angle sensor 4 is determined as a crank reference position (time point b of FIG. 5). Then, after determining the crank reference position, when the first cam signal pulse of cam signal PHASE (time point c of FIG. 5) is detected, a rotational phase angle from the crank reference position to the first cam signal pulse (between time points b and c of FIG. 5) is calculated. Thus, the actual rotational phase angle of intake camshaft 3 with respect to crankshaft 2, that is, absolute position θ1 of electric VTC 14, can be determined. Then, by starting drive of electric motor 6 to drive electric VTC 14 at the time when the first cam signal pulse is detected (time point c of FIG. 5), at which the actual rotational phase angle of intake camshaft 3 is obtained as described in the foregoing, the risk of damage to electric VTC 14 can be avoided.

Regarding the electric VTC position of FIG. 5, the broken line indicates a relative angle of electric VTC 14, which is obtained by using motor rotation sensor 15 and crank angle sensor 4. During a time period from the start of cranking until the actual rotational phase angle of intake camshaft 3 (absolute position θ1 of electric VTC 14) is obtained, the absolute position of electric VTC 14 is unknown, and thus, the absolute position of electric VTC 14 and the relative angle disagree. However, when the actual rotational phase angle of intake camshaft 3, that is, absolute position θ1 of electric VTC 14 is obtained, the absolute position of electric VTC 14 and the relative angle agree, and thereafter, electric VTC 14 is driven based on a drive with the feedback control of electric motor 6 and the relative angle gradually increases to approach a target position θtr. On the other hand, the absolute position of electric VTC 14 also changes to approach target position θtr. However, every time a cam signal pulse from cam sensor 5 is detected, a new absolute position of electric VTC 14 is computed and updated, and accordingly, until the next cam signal pulse is detected, the absolute position at that time remains unchanged. Thus, the absolute position of electric VTC 14 changes in a stepwise manner to approach target position θtr as seen in FIG. 5.

In FIG. 5, cam signal PHASE is indicated as a single pulse signal, focusing on the cam signal output alone, and only the first signal of each of three, four, and two pulse signals consecutively changing to be high level, which are used to determine the rotational phase angle of intake camshaft 3 with respect to crankshaft 2, for the sake of brevity. The horizontal axis of FIG. 5 represents time. Hereunder, FIGS. 6 to 9 are depicted in a similar manner.

In the method as indicated in FIG. 5, the first actual rotational phase angle of intake camshaft 3 (the absolute position of electric VTC 14) calculated after startup is obtained based on a cam signal pulse detected after the determination of the crank reference position as described above, and thus, the cam signal pulse detected before the determination of the crank reference position is not taken into account. This results in a delay in a starting timing to drive electric VTC 14. Such a delay in the starting timing of driving might have adverse effects on startup performance of a vehicle.

Thus, the control apparatus for electric VTC 14 according to the present invention is aimed to avoid the damage risk of electric VTC 14, while achieving rapid start of driving of electric VTC 14. Hereinbelow, a control method of electric VTC 14 according to the present invention will be described in detail.

First, a first embodiment of a control method of electric VTC 14 of the present invention will be described with reference to FIG. 6.

First Embodiment

Figure 6:
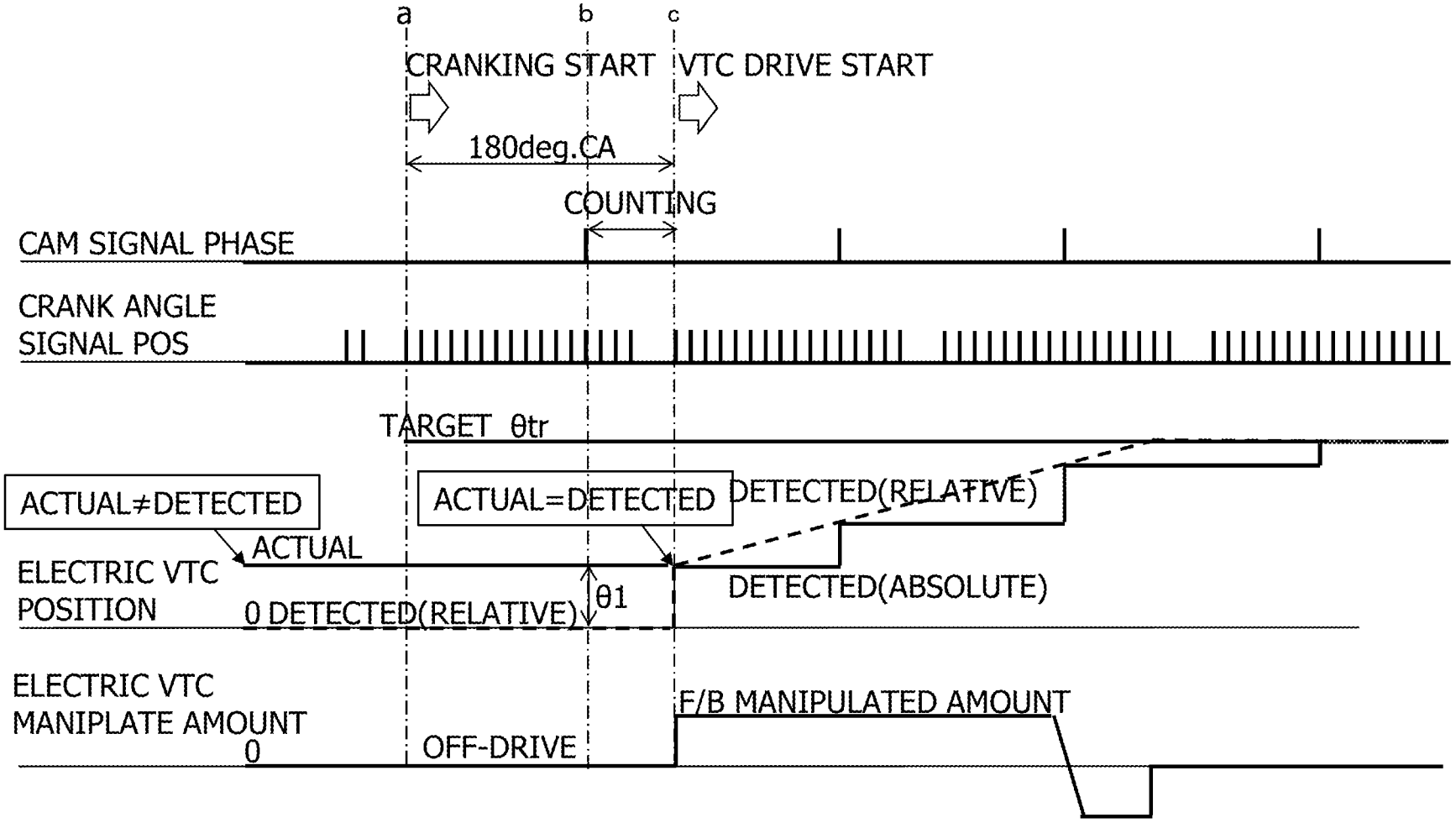
FIG. 6 is a timing chart for describing a first embodiment of a control method for the variable valve timing mechanism of the present invention.

First, as a first step, a starter motor, not illustrated, is turned on, to start cranking of internal combustion engine 1 (time point a of FIG. 6). This causes crankshaft 2 to start rotating, and accordingly, intake camshaft 3 thereby starts rotating.

Next, as a second step, electronic control unit 7 starts receiving crank angle signal POS output from crank angle sensor 4 in response to the rotation of crankshaft 2.

Simultaneously, electronic control unit 7 starts receiving cam signal PHASE output from cam sensor 5 in response to the rotation of intake camshaft 3.

Then, as a third step, after the start of cranking (time point a of FIG. 6), electronic control unit 7 obtains a first cam signal pulse of cam signal PHASE (time point b of FIG. 6). Then, when the first cam signal pulse is obtained, electronic control unit 7 starts counting up in response thereto, the counting up being performed every 10 degrees in the crank angle.

Furthermore, as a fourth step, after the detection of the first cam signal pulse, electronic control unit 7 determines that a first reference position of crank angle signal POS output from crank angle sensor 4 is a crank reference position (time point c of FIG. 6). Then, based on the count value counted after the first cam signal pulse is obtained until the crank reference position is detected, electronic control unit 7 computes a rotational phase angle between the first cam signal pulse and the crank reference position (between time points b and c of FIG. 6). The result is temporarily stored in a storage unit. In this case, when the count value is represented by n (n is a positive integer), the rotational phase angle can be n×10 degrees.

As a fifth step, electronic control unit 7 computes an actual rotational phase angle of intake camshaft 3 with respect to crankshaft 2 (between time points a and b of FIG. 6) based on the first cam signal pulse and the crank reference position. Specifically, since the reference positions of the crank angle signal are output at intervals of 180 degrees in the crank angle, a crank angle between the crank reference position determined above and a previous reference position is 180 degrees (fixed value). Thus, a crank angle between the previous reference position of the above crank reference position and the first cam signal pulse can be "180 degrees−n×10 degrees". That is, this crank angle is determined as the actual rotational phase angle of intake camshaft 3 with respect to crankshaft 2, that is, absolute position θ1 of electric VTC 14 at the time of the detection of the first cam signal pulse after startup.

Although FIG. 6 indicates a case in which the time point of the start of cranking and the reference position of crank angle signal POS coincide with each other, these may not always coincide.

When the absolute position of electric VTC 14 is calculated as described above, electronic control unit 7 starts driving electric motor 6 to drive electric VTC 14, at the time of calculation (time point c of FIG. 6). Then, similarly to FIG. 5, electric motor 6 is driven with the feedback control in order to have the absolute position of electric VTC 14 reach target position θtr. Thus, the absolute position of electric VTC 14 is being changed to become target position θtr.

As indicated in FIG. 6, after electric VTC 14 starts driving, an absolute position of electric VTC 14 is computed and updated every time a cam signal pulse of cam signal PHASE is detected.

Figure 7:
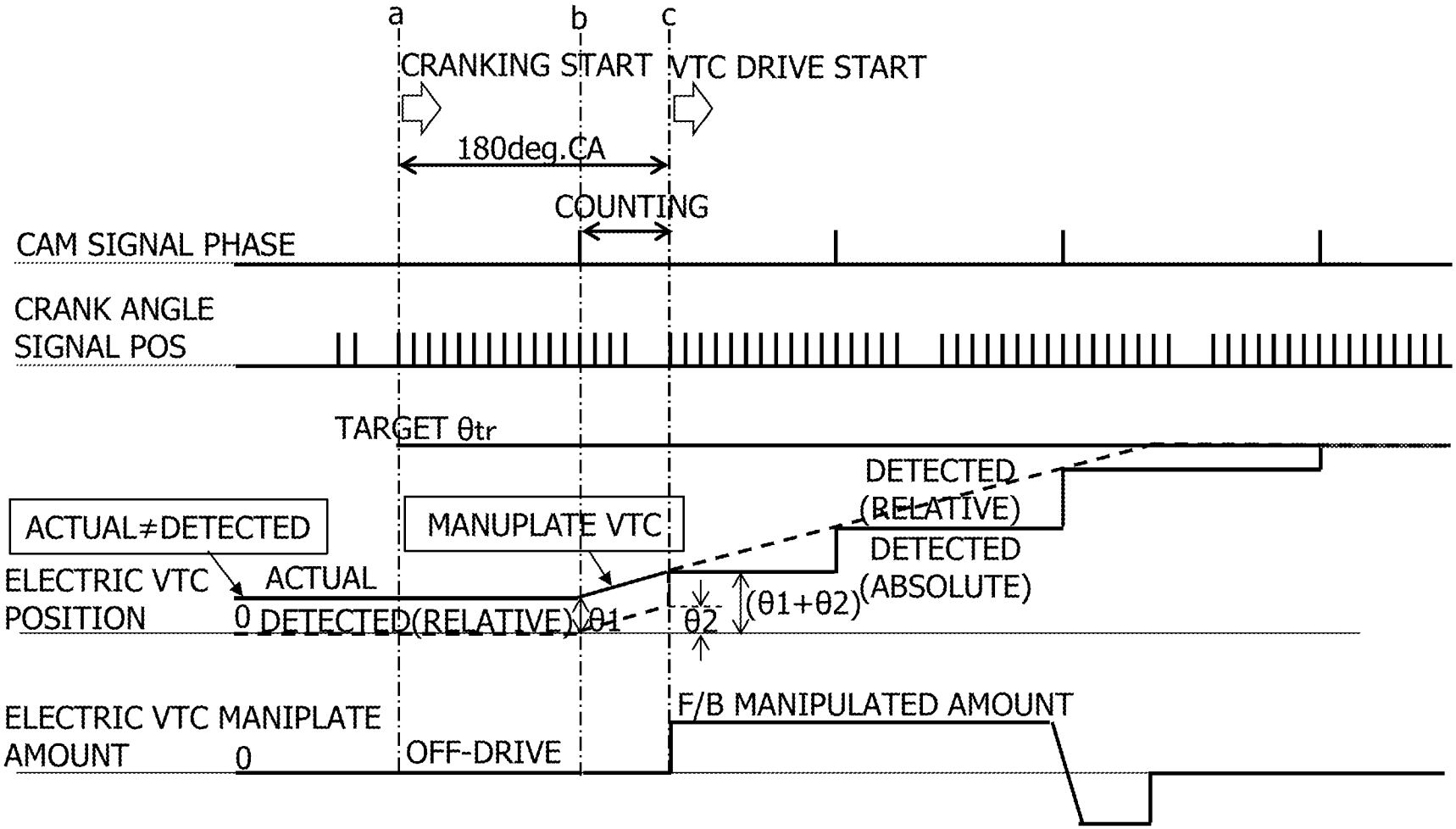
FIG. 7 is a timing chart for describing a second embodiment of a control method for the variable valve timing mechanism of the present invention.

FIG. 7 is a timing chart for describing a second embodiment of a control method of electric VTC 14 of the present invention. Hereinbelow, the second embodiment will be described with reference to FIG. 7. The differences from the first embodiment are described below.

Second Embodiment

If electric motor 6 has been displaced due to, for example, an external force applied thereto, after start of cranking and in a period from the detection of a first cam signal until the determination of a crank reference position (between time points b and c of FIG. 7), the position of electric VTC 14 may deviate from absolute position θ1 of electric VTC 14 determined based on the first cam signal and the crank reference position. If electric VTC 14 is driven in such a state, electronic control unit 7 might determine that a true position of electric VTC 14 is the determined absolute position θ1, and might determine a manipulated amount of electric motor 6 based on the position and target position θtr, to drive electric motor 6. Thus, in such a case, there might be a risk of damage to electric motor 6.

Thus, in the control method of electric VTC 14 according to the second embodiment of the present invention, in a case in which electric motor 6 is displaced in a period from the determination of the first actual rotational phase angle (absolute position θ1 of electric VTC 14) of intake camshaft 3 after startup until the determination of the crank reference position (i.e., the period is from time point b to time point c of FIG. 7), a motor shaft rotational angle (manipulated amount) of electric motor 6 is obtained by motor rotation sensor 15, and, at the time of the determination of the crank reference position (time point c of FIG. 7), the absolute position of electric VTC 14 is corrected by adding motor shaft rotational angle (manipulated amount) θ2 to the determined absolute position θ1 of electric VTC 14. In this way, the true position (θ1+θ2) of electric VTC 14 is determined. The drive control of electric VTC 14 thereafter is the same as that in the first embodiment.

Figure 8:
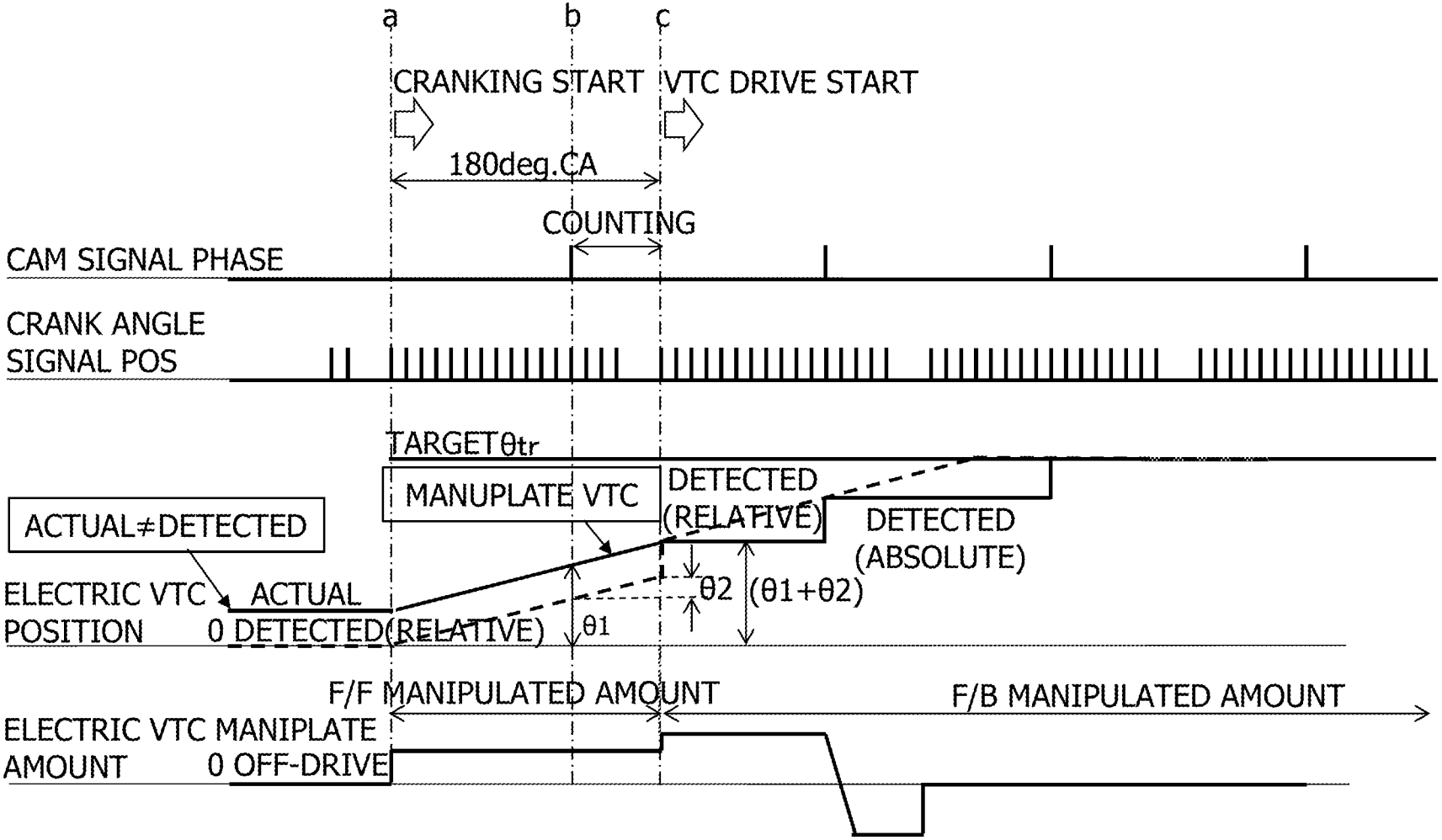
FIG. 8 is a timing chart for describing a third embodiment of a control method for the variable valve timing mechanism of the present invention.

FIG. 8 is a timing chart for describing a third embodiment of a control method of electric VTC 14 of the present invention. Hereinbelow, the third embodiment will be described with reference to FIG. 8.

Third Embodiment

In order to reduce the adverse effects of positional deviation of electric VTC 14 caused by an external force, the drive of electric motor 6 may be started simultaneously at start of cranking with a feedforward control by a predetermined manipulated amount. In this case, an absolute position of electric VTC 14 at the time when a first cam signal pulse after the start of cranking (time point a of FIG. 8) is detected (time point b of FIG. 8) is calculated as in the first embodiment, and the absolute position is θ1.

Since electric motor 6 continues rotating thereafter, electric VTC 14 keeps moving during a period from the detection of the first cam signal pulse until the determination of the crank reference position (between time points b and c of FIG. 8), and thus, the true position of electric VTC 14 differs from absolute position θ1 of electric VTC 14 calculated based on the first cam signal pulse and the crank reference position. Thus, in the third embodiment of the present invention, motor shaft rotational angle (manipulated amount) θ2 of electric motor 6, which has been displaced in a period from the detection of the first cam signal pulse until the determination of the crank reference position (between time points b and c of FIG. 8), is obtained by motor rotation sensor 15, and, at the time of the determination of the crank reference position, the absolute position of electric VTC 14 is corrected by adding motor shaft rotational angle (manipulated amount) θ2 to the calculated absolute position θ1 of electric VTC 14 (θ1+θ2). The drive control of electric VTC 14 thereafter is the same as that in the first embodiment. In this way, the response of electric VTC 14 can be further improved.

Figure 9:
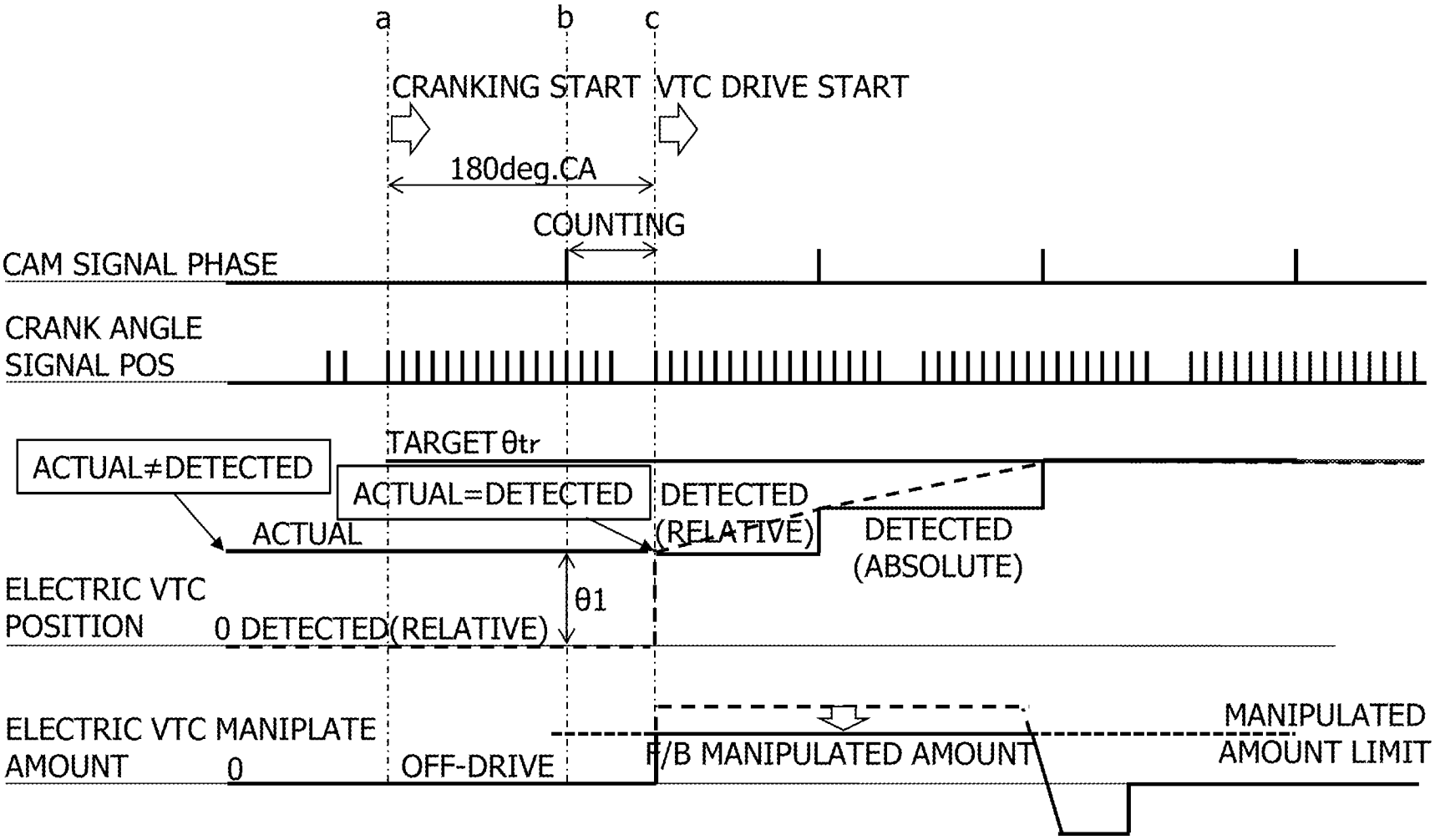
FIG. 9 is a timing chart for describing a fourth embodiment of a control method for the variable valve timing mechanism of the present invention.

FIG. 9 is a timing chart for describing a fourth embodiment of a control method of electric VTC 14 of the present invention. Hereinbelow, the fourth embodiment will be described with reference to FIG. 9.

Fourth Embodiment

When the absolute position of electric VTC 14 is other than a default position at which electric VTC 14 should be positioned in general when internal combustion engine 1 is in a stop state, there might be the risk of damage to electric VTC 14, as mentioned above. Thus, in the control method of electric VTC according to the fourth embodiment of the present invention, a feedback manipulated amount of electric motor 6 at start of driving of electric VTC 14 is reduced for a predetermined time period set in advance, as indicated in FIG. 9. Thus, the speed of movement of electric VTC 14 can be thereby reduced, and it becomes possible to avoid the risks of colliding of stopper convex portion 19 illustrated in FIG. 4 with the opposite edges of stopper concave groove 20 of intake camshaft 3 due to overshoot of electric VTC 14, resulting in damage, or the risks of engaging and locking occurring in the cam mechanism for driving electric VTC 14.

The embodiments described above are not carried out when electric VTC 14 has learned the default position. Furthermore, the embodiments are not carried out when the target position of the rotational phase angle of intake camshaft 3 is not within a manipulated angle range between an advance side control limit and a retard side control limit of electric VTC 14.

REFERENCE SYMBOL LIST

1 Internal combustion engine (engine)
2 Crankshaft
3 Intake camshaft
4 Crank angle sensor
5 Cam sensor
6 Electric motor (actuator)
7 Electronic control unit (control unit)
14 Electric VTC (variable valve timing mechanism)
15 Motor rotation sensor (actuator sensor)

The invention claimed is:

1. A control apparatus for a variable valve timing mechanism, comprising:

a crank angle sensor configured to output a crank angle signal in response to rotation of a crankshaft, the crank angle signal being set in advance to indicate at least two reference positions;

a cam sensor configured to output at least two cam signal pulses in response to rotation of an intake camshaft for opening and closing an engine valve;

an actuator configured to relatively rotate the intake camshaft with respect to the crankshaft, such that the actuator is able to change a rotational phase angle of the intake camshaft with respect to the crankshaft; and a control unit programmed to compute, based on (a) a first cam signal pulse detected after start of cranking and (b) a first reference position of the crank signal detected after the first cam signal pulse is detected, an actual rotational phase angle of the intake camshaft at the time of detecting the first cam signal pulse, to calculate an absolute position of the variable valve timing mechanism.

2. The control apparatus for the variable valve timing mechanism according to claim 1, wherein the control unit is programmed to switch a drive mode of the actuator from an OFF-drive to a drive with a feedback control, or from a drive with a feedforward control to the drive with the feedback control, at a time when the absolute position of the variable valve timing mechanism is calculated.

3. The control apparatus for the variable valve timing mechanism according to claim 1, wherein the control unit is programmed such that when the actuator is manipulated in a time period from the detection of the first cam signal pulse after the start of cranking until the detection of the first reference position of the crank angle signal, the control unit obtains a manipulated amount of the actuator by an actuator sensor, to correct the absolute position of the variable valve timing mechanism based on the obtained manipulated amount.

4. The control apparatus for the variable valve timing mechanism according to claim 1, wherein the control unit is programmed such that, when the actuator is manipulated with a feedforward control after the start of cranking, the control unit obtains a manipulated amount of the actuator by an actuator sensor to correct the absolute position of the variable valve timing mechanism based on a manipulated amount from the detection of the first cam signal pulse after the start of cranking until the detection of the first reference position of the crank angle signal, among the obtained manipulated amounts.

5. The control apparatus for the variable valve timing mechanism according to claim 2, wherein the control unit is programmed such that when the absolute position of the variable valve timing mechanism is other than an initial position of when an engine is stopped, the control unit drives the actuator while reducing a feedback manipulated amount of the actuator.

6. A control method of a variable valve timing mechanism, comprising:

a first step of starting cranking;

a second step of starting to receive a crank angle signal output from a crank angle sensor in response to rotation of a crankshaft, the crank angle signal being set in advance to indicate at least two reference positions, and starting to receive at least two cam signal pulses output from a cam sensor in response to rotation of an intake camshaft for opening and closing an engine valve;

a third step of obtaining a first cam signal pulse after the starting of cranking;

a fourth step of obtaining a first reference position of the crank angle signal after the third step; and a fifth step of computing an actual rotational phase angle of the intake camshaft with respect to the crankshaft at the time of detecting the first cam signal pulse, based on the cam signal pulse obtained in the third step and the reference position obtained in the fourth step, to calculate an absolute position of the variable valve timing mechanism.

* * * * *